US007893407B2

(12) United States Patent
Syms

(10) Patent No.: US 7,893,407 B2
(45) Date of Patent: Feb. 22, 2011

(54) HIGH PERFORMANCE MICRO-FABRICATED ELECTROSTATIC QUADRUPOLE LENS

(75) Inventor: Richard Syms, London (GB)

(73) Assignee: Microsaic Systems, Ltd., Woking, Surrey (GB)

( * ) Notice: Subject to any disclaimer, the term of this patent is extended or adjusted under 35 U.S.C. 154(b) by 317 days.

(21) Appl. No.: 12/012,000

(22) Filed: Jan. 29, 2008

(65) Prior Publication Data

US 2008/0185518 A1 Aug. 7, 2008

(30) Foreign Application Priority Data

Jan. 31, 2007 (GB) ..... 0701809.6

(51) Int. Cl.
*H01J 49/00* (2006.01)

(52) U.S. Cl. ..... 250/396 R; 250/281; 250/283; 250/288; 250/290; 250/292

(58) Field of Classification Search ..... 250/281, 250/282, 283, 288, 290, 292, 396 R
See application file for complete search history.

(56) References Cited

U.S. PATENT DOCUMENTS

| | | | | | |
|---|---|---|---|---|---|
| 3,129,327 | A | | 4/1964 | Brubaker | |
| 3,371,204 | A | | 2/1968 | Brubaker | |
| 3,699,330 | A | * | 10/1972 | McGinnis | 250/290 |
| 3,717,785 | A | * | 2/1973 | Guernet | 250/396 R |
| 4,032,782 | A | * | 6/1977 | Smith et al. | 250/292 |
| 4,963,736 | A | * | 10/1990 | Douglas et al. | 250/292 |
| 5,373,157 | A | * | 12/1994 | Hiroki et al. | 250/292 |
| 5,401,962 | A | * | 3/1995 | Ferran | 250/292 |
| 5,596,193 | A | * | 1/1997 | Chutjian et al. | 250/292 |
| 5,719,393 | A | * | 2/1998 | Chutjian et al. | 250/292 |
| 5,852,270 | A | * | 12/1998 | Holkeboer | 219/69.12 |
| 5,852,294 | A | * | 12/1998 | Gulcicek et al. | 250/292 |
| 6,025,591 | A | * | 2/2000 | Taylor et al. | 250/292 |
| 6,157,031 | A | * | 12/2000 | Prestage | 250/292 |
| 6,194,717 | B1 | * | 2/2001 | Hager | 250/292 |
| 6,329,654 | B1 | * | 12/2001 | Gulcicek et al. | 250/293 |
| 6,465,792 | B1 | * | 10/2002 | Baptist | 250/396 R |
| 6,972,406 | B2 | * | 12/2005 | Syms | 250/281 |

(Continued)

FOREIGN PATENT DOCUMENTS

GB 2391694 A 2/2004

OTHER PUBLICATIONS

Batey, J.H., "Quadrupole gas analysers," *Vacuum* 37, 659-668, 1987.

(Continued)

*Primary Examiner*—Robert Kim
*Assistant Examiner*—Michael J Logie
(74) *Attorney, Agent, or Firm*—Bishop & Diehl, Ltd.

(57) ABSTRACT

A method of aligning sets of cylindrical electrodes in the geometry of a miniature quadrupole electrostatic lens, which can act as a mass filter in a quadrupole mass spectrometer is provided. The electrodes are mounted in pairs on microfabricated supports, which are formed from conducting parts on an insulating substrate. Complete segmentation of the conducting parts provides low capacitative coupling between co-planar cylindrical electrodes, and allows incorporation of a Brubaker prefilter to improve sensitivity at a given mass resolution. A complete quadrupole is constructed from two such supports, which are spaced apart by further conducting spacers. The spacers are continued around the electrodes to provide a conducting screen.

26 Claims, 9 Drawing Sheets

U.S. PATENT DOCUMENTS

| | | | | |
|---|---|---|---|---|
| 7,067,802 | B1 * | 6/2006 | Kovtoun | 250/282 |
| 7,166,836 | B1 * | 1/2007 | Russ et al. | 250/281 |
| 7,208,729 | B2 * | 4/2007 | Syms | 250/288 |
| 7,435,953 | B2 * | 10/2008 | Freeouf | 250/292 |
| 2001/0042826 | A1 * | 11/2001 | Chutjian et al. | 250/283 |
| 2010/0019143 | A1 * | 1/2010 | Dobson et al. | 250/283 |

OTHER PUBLICATIONS

Denison, D.R., "Operating Parameters of a Quadrupole in a Grounded Cylindrical Housing," *Journal of Vacuum Science and Technology*, vol. 8, No. 1, 266-269, 1971.

Brubaker, W.M., "Improved Quadrupole," Manuscript accepted for presentation at the Mass Spectroscopy Conference in Berlin, Sep. 25-29, 1967, and for publication in "Advance in Mass Spectrometry," vol. 4.

Syms, R.R.A., et al., "Fabrication of a microengineered quadrupole electrostatic lens," *Electronic Letters*, Oct. 24, 1996, vol. 32, No. 22.

Syms, R.R.A., et al., "Design of a Microengineered Electrostatic Quadrupole Lens," *IEEE Trans. On Electron Devices*, vol. 45, No. 11, 2304-2311, Nov. 1998.

Taylor, S., et al., "Performance improvements for a miniature quadrupole with a micromachined mass filter," *Vacuum*, 53, 203-206, 1999.

Geear M.., et al., "Monolithic MEMS Quadrupole Mass Spectrometers by Deep Silicon Etching," *Journal of Microelectromechanical Systems*, vol. 14, No. 5, 1156-1166, Oct. 2005.

Sillon, N., et al., "Micromachined mass spectrometer," *Sensors and Actuators*, B 83, 129-137, 2002.

Taylor S. et al., "Silicon based quadrupole mass spectrometry using microelectromechanical systems," Journal of Vacuum Science and Technology: Part B, vol. 19, No. 2, pp. 557-562, Mar. 1, 2001, AVS/AIP, Melville, NY, USA.

* cited by examiner

HIGH PERFORMANCE MICRO-FABRICATED ELECTROSTATIC QUADRUPOLE LENS

CROSS-REFERENCE TO RELATED APPLICATIONS

This application claims priority to United Kingdom Application GB0701809.6, filed Jan. 31, 2007, which is hereby incorporated by reference.

FEDERALLY SPONSORED RESEARCH OR DEVELOPMENT

Not Applicable.

TECHNICAL FIELD

This invention relates to mass spectrometry, and in particular to the provision of a miniature electrostatic quadrupole mass filter with high range, low noise and high sensitivity.

BACKGROUND OF THE INVENTION

Miniature mass spectrometers have application as portable devices for the detection of biological and chemical warfare agents, drugs, explosives and pollutants, as instruments for space exploration, and as residual gas analysers.

Mass spectrometers consist of three main subsystems: an ion source, an ion filter, and an ion counter. One of the most successful variants is the quadrupole mass spectrometer, which uses a quadrupole electrostatic lens as a mass filter. Conventional quadrupole lenses consist of four cylindrical electrodes, which are mounted accurately parallel and with their centre-to-centre spacing at a well-defined ratio to their diameter [Batey 1987].

Ions are injected into the pupil between the electrodes, and travel parallel to the electrodes under the influence of a time-varying hyperbolic electrostatic field. This field contains both a direct current (DC) and an alternating current (AC) component. The frequency of the AC component is fixed, and the ratio of the DC voltage to the AC voltage is also fixed.

Studies of the dynamics of an ion in such a field have shown that only ions of a particular charge to mass ratio will transit the quadrupole without discharging against one of the rods. Consequently, the device acts as a mass filter. The ions that successfully exit the filter may be detected. If the DC and AC voltages are ramped together, the detected signal is a spectrum of the different masses that are present in the ion flux. The largest mass that can be detected is determined from the largest voltage that can be applied.

The resolution of a quadrupole filter is determined by two main factors: the number of cycles of alternating voltage experienced by each ion, and the accuracy with which the desired field is created. So that each ion experiences a large enough number of cycles, the ions are injected with a small axial velocity, and a radio frequency (RF) AC component is used. This frequency must be increased as the length of the filter is reduced.

The sensitivity and hence the overall performance of a mass spectrometer is also affected by the signal level and the noise level. Noise arising from stray ions is conventionally reduced by the use of a grounded screen [Denison 1971]. The ion transmission is clearly reduced as the size of the entrance pupil is decreased. Efforts have therefore been made to improve transmission in small quadrupoles, and it has been shown that significantly improved transmission at a given resolution can be obtained by reducing the effect of fringing fields at the input to the quadrupole.

One effective method involves the use of a so-called Brubaker lens or Brubaker pre-filter, which consists of an additional set of four short, cylindrical electrodes mounted co-linearly with the main quadrupole electrodes. The Brubaker pre-filter is excited with the AC voltages (but not the DC voltages) applied to the main quadrupole lens. It is well known that a quadrupole excited only with AC voltages acts as an all-pass filter, so that the Brubaker pre-filter provides an ion guide into the main quadrupole. However, the delay in application of the DC voltage component results in a reduction in fringing fields and significantly improves overall ion transmission at a given mass resolution [Brubaker 1968; U.S. Pat. No. 3,129,327; U.S. Pat. No. 3,371,204].

In order to create the desired hyperbolic field, highly accurate methods of construction are employed. However, it becomes increasingly difficult to obtain the required precision as the size of the structure is reduced [Batey 1987]. Microfabrication methods are therefore increasingly being employed to miniaturise mass spectrometers, both to reduce costs and allow portability.

Microfabricated devices are often fabricated on silicon wafers, because of the range of compatible deposition, patterning and etching processes that may be used. However, the resistivity of silicon is inherently limited to that of intrinsic material, and the thickness of deposited insulating films is limited by the stress in such films. These restrictions have particular consequences for the performance of RF devices such as electrostatic quadrupole mass filters formed in silicon.

For example, a silicon-based quadrupole electrostatic mass filter consisting of four cylindrical electrodes mounted in pairs on two oxidised, silicon substrates was demonstrated some years ago. The substrates were held apart by two cylindrical insulating spacers, and V-shaped grooves formed by anisotropic wet chemical etching were used to locate the electrodes and the spacers. The electrodes were metal-coated glass rods soldered to metal films deposited in the grooves. [U.S. Pat. No. 6,025,591].

Mass filtering was demonstrated using devices with electrodes of 0.5 mm diameter and 30 mm length [Syms et al. 1996; Syms et al. 1998; Taylor et al. 1999]. However, the performance was limited by RF heating, caused by capacitative coupling between co-planar cylindrical electrodes through the oxide interlayer via the substrate. As a result, the device presented a poor electrical load, and the solder attaching the electrodes tended to melt. These effects restricted the voltage and frequency that could be applied, which in turn limited both the mass range (to around 100 atomic mass units) and the mass resolution. While the substrate was grounded, the use of an incomplete screen also resulted in high noise levels, and the devices also suffered in low transmission rates.

In an effort to overcome these limitations, an alternative construction based on bonded silicon-on-insulator (BSOI) was developed [GB 2391694]. BSOI consists of an oxidised silicon wafer, to which a second silicon wafer has been bonded. The second wafer may be polished back to the desired thickness, to leave a silicon-oxide-silicon multi-layer.

In this geometry, the electrode rods were again mounted in pairs on two substrates. However, the electrodes were now retained by silicon springs etched into the substrate of the BSOI wafer, while the device layer was used as a spacer. The oxide interlayer was largely removed, so that capacitative coupling between co-planar cylindrical electrodes via the substrate was greatly reduced. As a result, the device could withstand considerably higher voltages, and a mass range of 400 atomic mass units was demonstrated [Geear et al. 2005].

Despite these results, only partial screening was again possible. Furthermore, it was found that the transmission was again low, because of obstruction of the entrance pupil by the features such as springs and hooks mounting the cylindrical electrodes. These features also hampered the incorporation of auxiliary optics such as a Brubaker pre-filter.

A further microfabricated quadrupole filter, described as a "square rods quadrupole" and based on a two-substrate assembly formed in silicon and mounting a set of polygonal rods, has also been described [Sillon and Baptist 2002; U.S. Pat. No. 6,465,792]. However, it does not appear to have been demonstrated.

Because many applications of mass spectrometry require greater mass range, there is a need to provide a more effective solution to the problem of RF heating. There is therefore a need to provide such a solution and also a requirement for mass spectrometer devices that are operable in conditions requiring low noise and greater sensitivity at a given resolution.

SUMMARY OF THE INVENTION

These and other problems are addressed by a mass spectrometer device in accordance with the teaching of the invention that eliminates the use of thin deposited oxide layers for electrical isolation in a microfabricated electrostatic quadrupole mass filter. A device in accordance with the teaching of the invention also addresses the problem of incorporating both a grounded screen and a Brubaker pre-filter. Such benefits are provided by incorporating a mount for the quadrupole electrodes in which any silicon parts are physically separated and attached to an insulating substrate.

In accordance with the teaching of the invention there is also provided a method of aligning sets of cylindrical electrodes in the geometry of a miniature quadrupole electrostatic lens, which can act as a mass filter in a quadrupole mass spectrometer. The electrodes are mounted in pairs on microfabricated supports, which are formed from conducting parts on an insulating substrate. Complete segmentation of the conducting parts provides low capacitative coupling between coplanar cylindrical electrodes, and allows incorporation of a Brubaker lens to improve sensitivity at a given mass resolution. A complete quadrupole is constructed from two such insulating substrates, which are spaced apart by further conducting spacers. The spacers are continued around the electrodes to provide a conducting screen.

Accordingly the invention provides a quadrupole lens according to claim 1. Advantageous embodiments are provided in the dependent claims.

These and other features of illustrative and exemplary embodiments will be better understood with reference to FIGS. 1-9 which follow.

BRIEF DESCRIPTION OF THE DRAWINGS

To understand the present invention, it will now be described by way of example, with reference to the accompanying drawings in which.

DETAILED DESCRIPTION

The invention will now be described with reference to exemplary embodiments which are provided to assist in an understanding of the teaching of the invention. While features may be described with reference to one figure it will be understood that such features could be used with or replaced by the features described in another figure as it is not intended to limit the invention to the interpretation of any one figure, as modifications can be made without departing from the scope of the invention. Such scope is only to be limited as is deemed necessary in the light of the appended claims.

Figure 1:
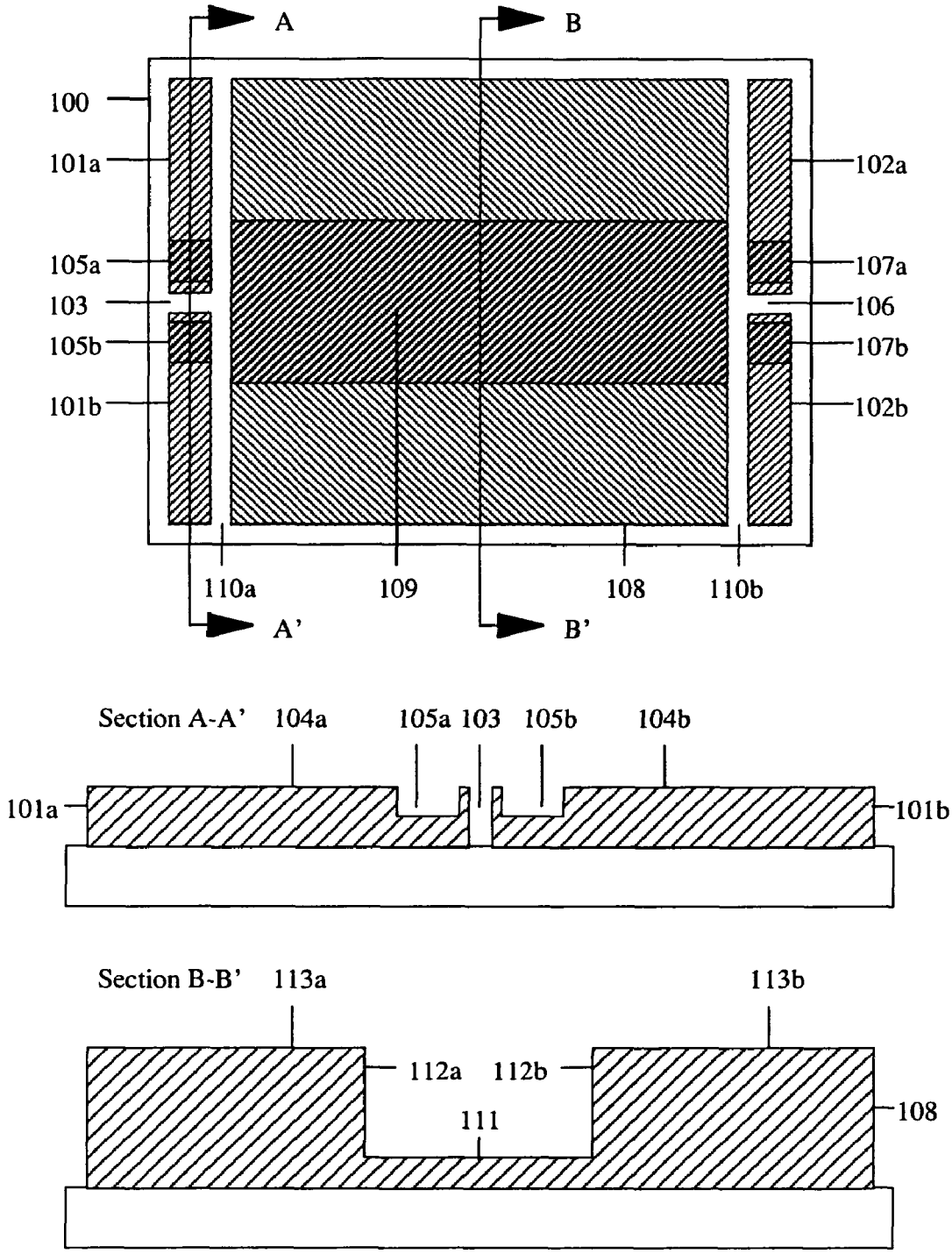
FIG. 1 shows in section and in plan a microfabricated mount for an electrostatic quadrupole lens containing laterally segmented conducting parts on an insulating substrate, according to the present invention.

In FIG. 1, an insulating substrate 100 is used to co-locate a variety of features formed in an additional layer of material that is either conductive or coated in a conductive layer. This additional layer may be fabricated or formed to provide different features such as one or more supporting members or shields, as will become apparent from the following description. Examples of suitable insulating substrate materials include glasses, ceramics and plastics. It will be understood that although any insulating material may be useful in the context of the teaching of the present invention that glasses are more suitable for the intended application in mass spectrometry because of their lower out-gassing rates under vacuum. Examples of suitable conducting materials include metals, and metal-coated semiconductors and insulators. Metal-coated silicon is of particular interest, since it may easily be structured using micro-fabrication processes such as photolithography and etching. However, metal structures may also be microfabricated by photolithography and electroplating.

At either end of the substrate, two pairs of support members or features 101*a*, 101*b* and 102*a*, 102*b* provide alignment for and electrical connection to a pair of inserted cylindrical electrodes. The combination of the support members and the insulating substrate form a microfabricated mount. Each of the pair of support members provide collectively a mounting member for their respective inserted electrode. Each of the two electrodes have the same diameter, and will ultimately act as two of the four electrodes in an electrostatic quadrupole lens. It will be evident that the electrodes, when received within the support members are aligned parallel to one another along a longitudinal axis which is substantially perpendicular to the Section Lines A-A' or B-B'. In this way it may be understood that the substrate has a longitudinal axis which is parallel to the electrodes and a transverse axis which is parallel to the Section Lines.

Mechanical alignment for the cylindrical electrodes which may be located in and supported by the support members 101*a* and 101*b* is provided using grooved locating features 105*a* and 105*b*, and similar features 107*a* and 107*b* are provided in the elements 102*a* and 102*b*. Suitable features include V-shaped, U-shaped and rectangular grooves, which may all be formed by microfabrication processes such as photolithography and etching. Suitable methods of attaching the cylindrical electrodes include the use of conductive epoxy and solder. It will be understood that the grooved supports or recesses 105*a*, 105*b* provide a support for their respective electrodes at a first end of each electrode and the grooved supports or recesses 107*a*, 107*b* provide support at a second end; each electrode has a length and is supported at either end of that length.

In accordance with the teaching of the invention the support members for each of the two electrodes are electrically isolated from one another. To achieve this electrical isolation between adjacent supports, the invention provides for a physical separation or trench 103, 106 to be provided between each of the adjacent supports 101*a*/101*b* and 102*a*/102*b* respectively. Each of the two trenches is formed in a direction parallel to the longitudinal axis of the electrodes. The formation of the trenches 103, 106 provides a physical separation between the adjacent supports which as they are each located on the insulating substrate achieves the necessary electrical isolation. Electrical connections along the length of each of the support features 101*a* and 101*b* is provided by the use of a conducting material, or by making their top surfaces 104*a* and 104*b* conducting by a deposited film. Electrical isolation between the features 102*a* and 102*b* is similarly provided by providing a physical separation 106, and electrical connections along the support features 102*a* and 102*b* are provided by the use of a conducting material or deposited film along their top surfaces. By coupling the electrodes to their respective locating features using a conductive material and having the upper surfaces of these features also conducting it is possible to provide an electrical connection between the support features and their respective supported electrodes.

The separations or trenches 103 and 106 are desirably formed using photolithographic or etching techniques and as such may be relatively large. Consequently, it will be appreciated that the capacitance between elements 101*a* and 101*b* and between elements 102*a* and 102*b* may be lower than using an alternative method based on a thin deposited insulating layer. Further, it will be appreciated that very small currents will flow between the elements 101*a* and 101*b* when the pair are excited by a radio frequency (RF) AC voltage. Consequently the arrangement will provide an electrical load more closely corresponding to an ideal capacitor, with reduced RF heating.

The trenches 103, 106 provide for longitudinal separation between the adjacent supports. It is also possible to provide for transverse isolation, such that each electrode is supported at either end by electrically isolated support members 101*a*/102*a* and 101*b*/102*b*. Such transverse isolation is provided in the arrangement of FIG. 1 by two transverse trenches 110*a*, 110*b* which extend in a direction substantially transverse to the longitudinal axis of the inserted electrodes. The formation of both transverse and longitudinal trenches effectively forms the individual support members 101*a*, 101*b*, 102*a*, 102*b* as islands on the substrate 100.

By isolating the support members in a transverse direction a gap is defined within which a shield may be provided. The shield serves to cover up portions of the insulating substrate which if exposed to ions could possibly otherwise become charged. As shown in FIG. 1, between the two pairs of electrode mounting features 101*a*, 101*b* and 102*a*, 102*b* is provided a further shielding feature in the form of a shield 108 containing a deep trench 109, which extends in a longitudinal axis substantially parallel to the intended location of the electrodes. The trench 109 has side surfaces or walls 112*a*, 112*b* which are upstanding from a bottom surface 111. The shield is also attached to the insulating substrate 100 but isolated from the electrode mounting features by the physical separations or trenches 110*a*, 110*b*. Electrical connection over the surface of the shielding feature 108 is provided by the use of a conducting material, or by making the surfaces 111, 112*a*, 112*b*, 113*a*, 113*b* conducting by a deposited conducting film. The depth and width of the trench which will define the vertical position of the conducting surface 111 and the lateral positions of the conducting surfaces 112*a*, 112*b* are chosen so that these surfaces do not make electrical contact with the electrodes when the electrodes are inserted into the grooves 105*a*, 105*b* and 107*a*, 107*b*. As shown in Section A-A' and B-B' of FIG. 1 and also the perspective view of FIG. 2 upper surfaces 113*a* and 113*b* of the shield are higher than upper surfaces 104*a* and 104*b* of the support members. By this it will be understood that the distance of the upper surfaces of the shield from the underlying substrate is greater than the distance of the upper surfaces of the support members from the underlying substrate.

Figure 2:
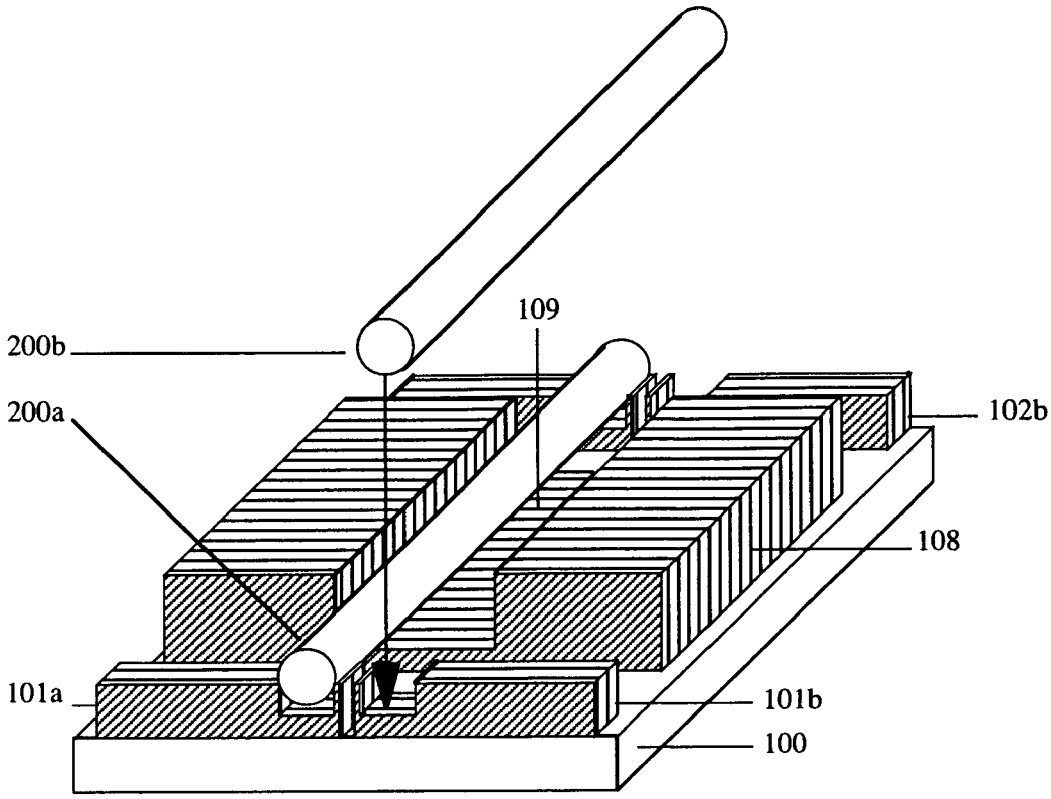
FIG. 2 shows in an isometric view the mounting of cylindrical electrodes in a microfabricated mount, according to the present invention.

FIG. 2 shows how two cylindrical electrodes 200*a*, 200*b* are inserted into the alignment grooves in the blocks 101*a*, 101*b* and 102*a*, 102*b*. It will be understood that the depth of the locating alignment grooves 101*a*, 101*b* and 102*a*, 102*b* is less than the depth of the trench 109 such that an electrode located in the alignment grooves will be suspended over the trench defined in the shield. By providing a suspension of the cylindrical electrodes at a distance from the trench 109 formed in the conducting surface of the shielding element 108, it will be appreciated that the trench can then provide a conducting shield extending at least partly around the cylindrical electrodes.

It will be appreciated that the dimensions of the five main features 101*a*, 101*b*, 102*a*, 102*b* and 108, and the separations 103, 106, 110*a* and 110*b* may all be accurately outlined using photolithography, as may those of the subsidiary features 105*a*, 105*b* and 107*a*, 107*b* and 109. It will also be appreciated that the relative heights above the insulating substrate of features such as 104*a*, 104*b*, 113*a*, and 113*b* may also be accurately defined by etching to a known depth. Consequently, the overall structure may be formed with well-defined dimensions using processes well known to those skilled in the art of micro-fabrication.

Figure 3:
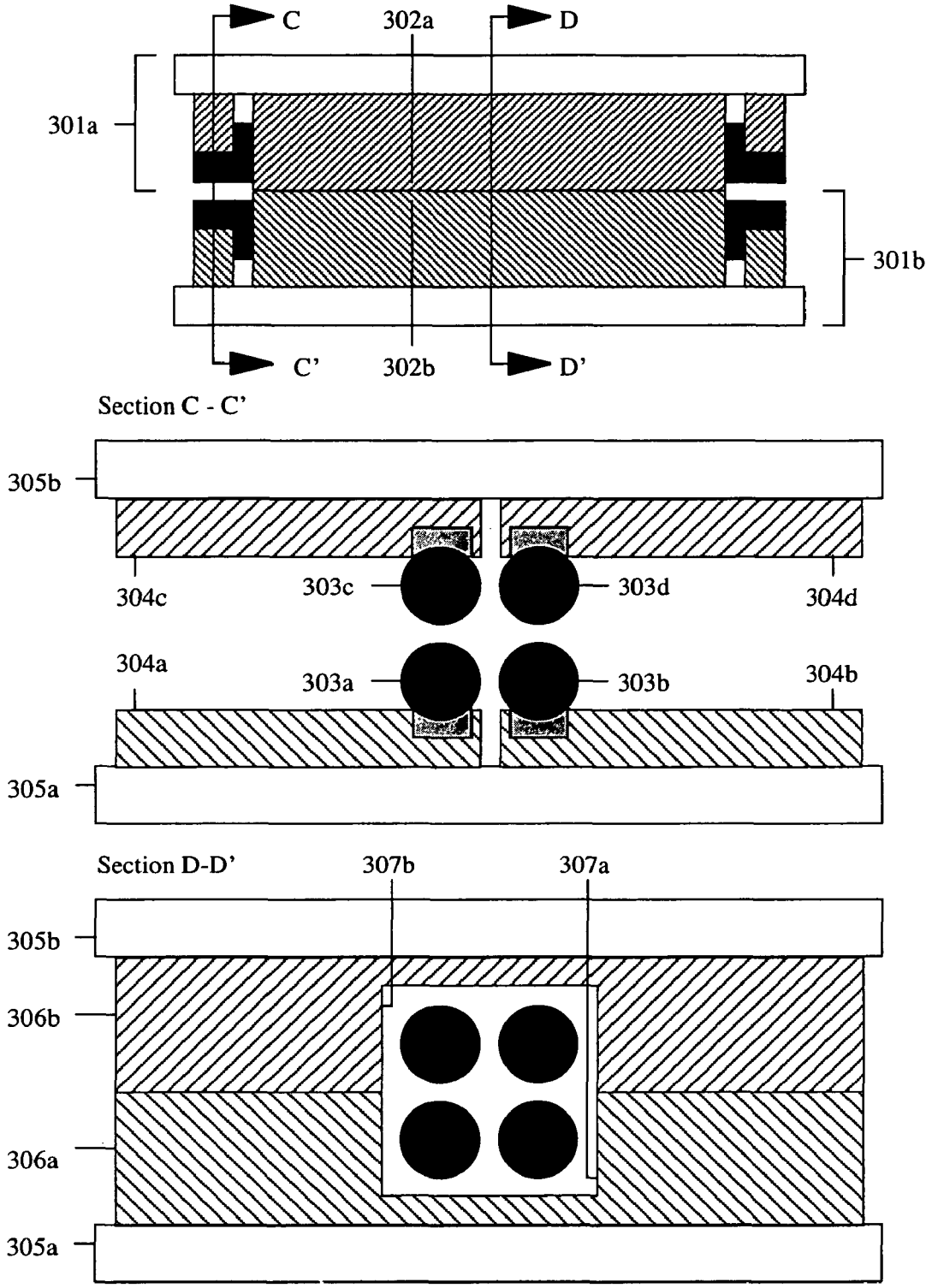
FIG. 3 shows in a side view and in two sections the mounting of cylindrical electrodes and the assembly of a complete microfabricated electrostatic quadrupole lens, according to the present invention.

FIG. 3 shows how a complete electrostatic quadrupole lens may be constructed from combining two such assemblies 301*a*, 301*b*, which are stacked together face to face so that conducting surfaces 302*a*, 302*b* of their shielding elements align and abut and form a sandwich structure. It will be appreciated that the assembly now provides a means whereby four cylindrical electrodes 303*a*, 303*b*, 303*c*, 303*d* may be supported at either end by grooves in similar conducting features 304*a*, 304*b*, 304*c*, 304*d*, which are held by and isolated from each other by two insulating substrates 305*a*, 305*b* which form outer surfaces of the sandwich structure. It will also be appreciated that the two insulating substrates 305*a*, 305*b* are supported and spaced apart by the two shielding features 306*a*, 306*b*.

With a suitable choice of dimensions, the assembly may therefore mount four similar cylindrical electrodes with their axes parallel and with their centres located on a square. Since the size of the square may be chosen appropriately compared with the diameter of the electrodes, the overall assembly provides the geometry of an electrostatic quadrupole lens.

It will also be appreciated that the conducting features 304*a*, 304*b*, 304*c*, 303*d* provide little obstruction in the space between the cylindrical electrodes, which forms the pupil of the quadrupole lens, so that the greater portion of the electrodes may provide a quadrupole field with low distortion. It will also be appreciated that the inner conducting surfaces 307*a*, 307*b* of the shielding features 306*a*, 306*b*, which correspond to the side walls of the trench 109 in FIG. 2, can now fully shield the four cylindrical electrodes along the greater portion of their length.

It will be understood that while only one quadrupole configuration is shown in the exemplary embodiments heretofore described that multiple quadrupoles may be constructed on the same substrate, in the form of a parallel array, to increase the overall ion flux and hence the sensitivity or that a serial array of multiple quadrupoles could also be formed on the same substrate. By providing a plurality of quadrupoles in parallel it is possible to increase throughput through the device whereas the provision of electrodes in series allows the fabrication of additional features such as for example a Brubaker lens or prefilter, as will be discussed below.

Figure 4:
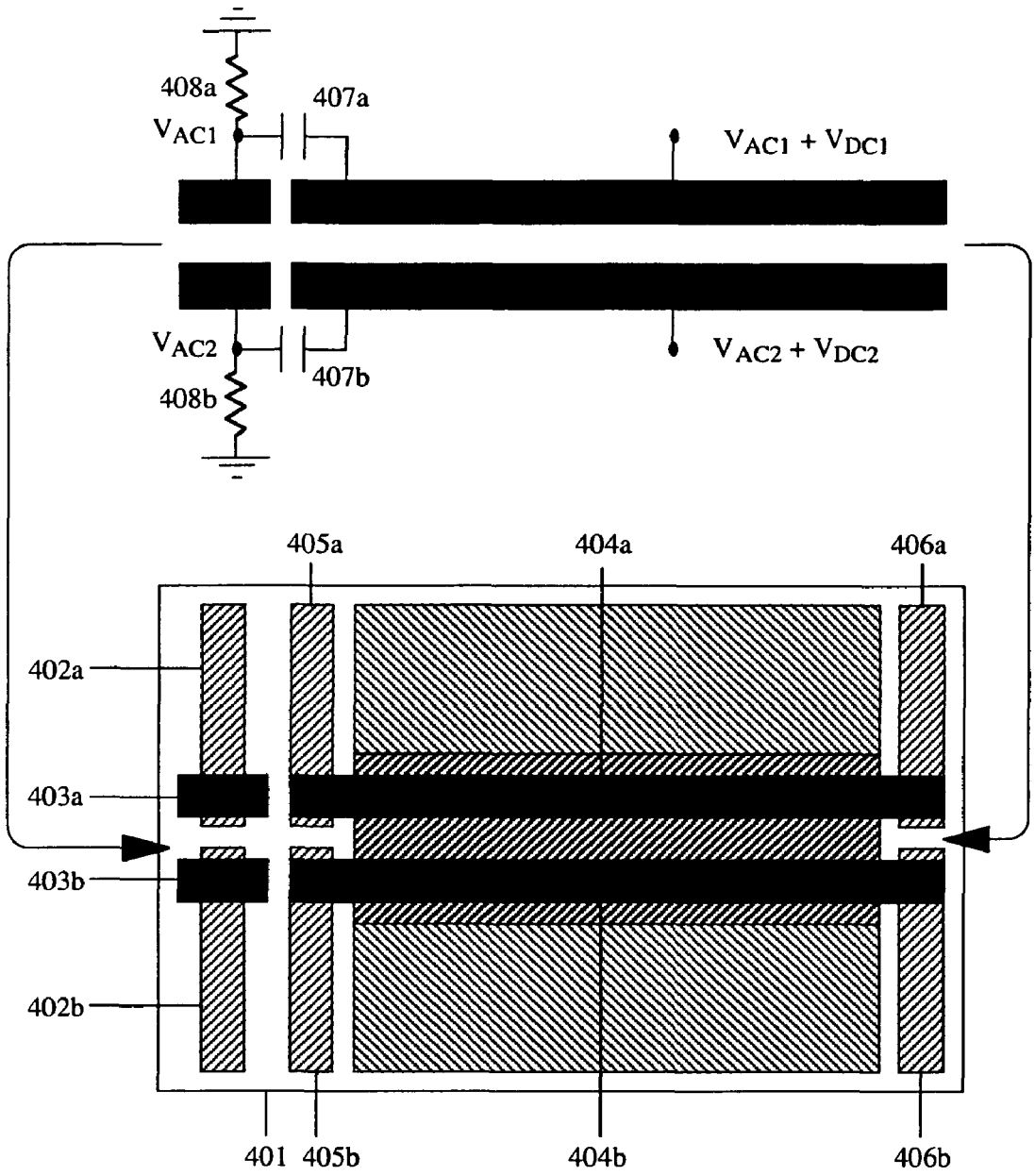
FIG. 4 shows the incorporation of an additional set of RF only electrodes in the geometry of a Brubaker lens, according to the present invention.

FIG. 4 shows one method of combining an electrostatic quadrupole lens with a Brubaker prefilter consisting of a RF-only quadrupole. Here each insulating substrate 401 is extended to allow the incorporation of extra mounting features 402*a*, 402*b* for a second pair of separate cylindrical electrodes 403*a*, 403*b* in addition to the pair of primary cylindrical electrodes 404*a*, 404*b* held in mounts 405*a*, 405*b* and 406*a*, 406*b*. The additional electrodes are aligned longitudinally with their respective primary cylindrical electrodes. Because the electrodes in a Brubaker prefilter are conventionally very short, a single set of mounting features holding the cylindrical electrodes at their midpoint will normally suffice. Again, suitable attachment methods include conductive glue and solder. It will be appreciated that the Brubaker electrodes may be mechanically contiguous with but electrically isolated from the main quadrupole electrodes. In this case, the mounting method is further simplified.

The short cylindrical electrodes 403*a*, 403*b* may be driven directly with the RF voltages VAC1, VAC2 supplied to the long cylindrical electrodes. Alternatively, they may be driven from the long cylindrical electrodes via capacitors 407*a*, 407*b* and resistors 408*a*, 408*b*, which provide a means to couple the RF voltages VAC1, VAC2 to the short cylindrical electrodes while ensuring that the DC voltage applied to the short cylindrical electrodes is substantially that of ground.

Figure 5:
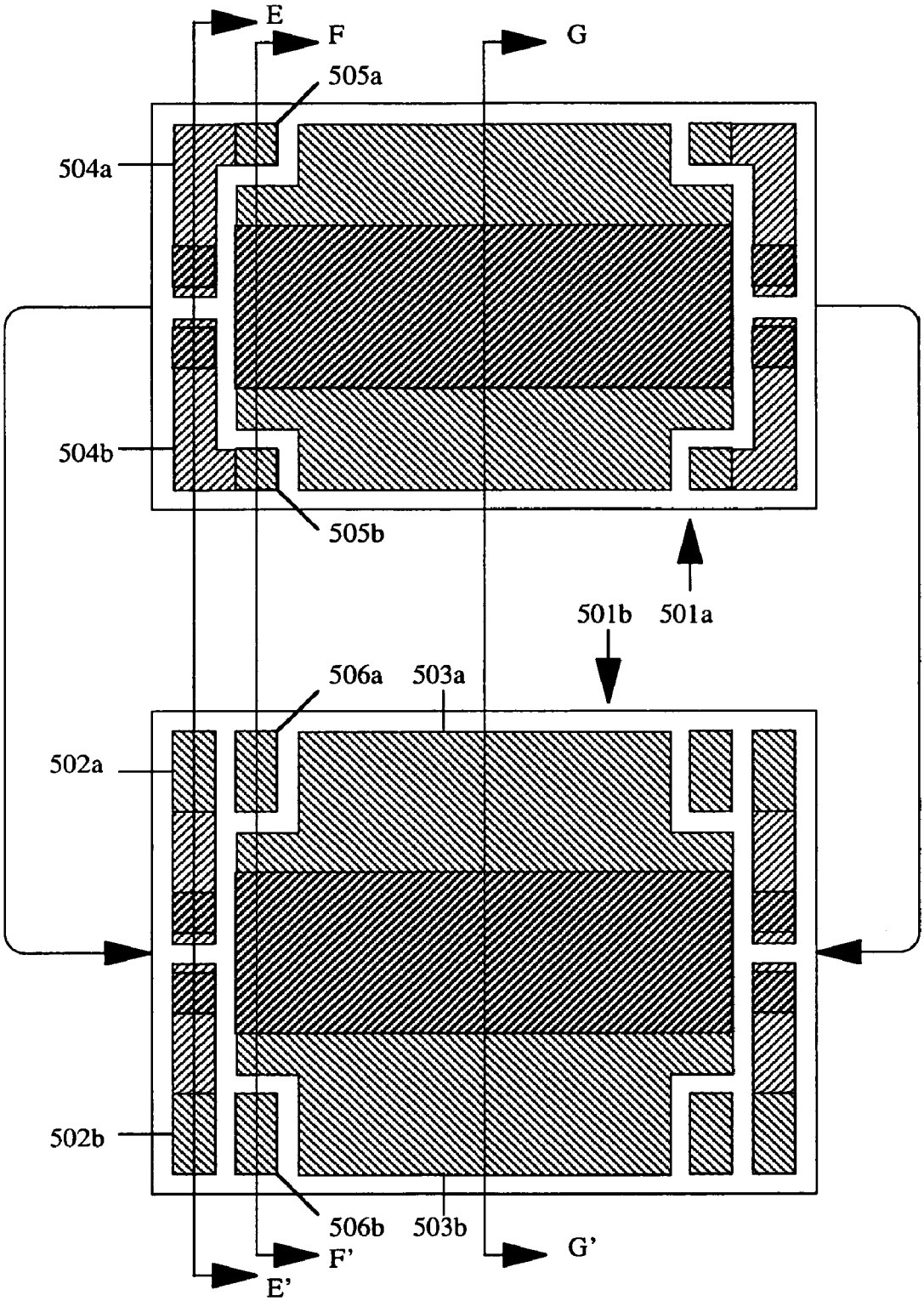
FIG. 5 shows in plan an arrangement providing all electrical connections to a microfabricated quadrupole on a single substrate, according to the present invention.
Figure 6:
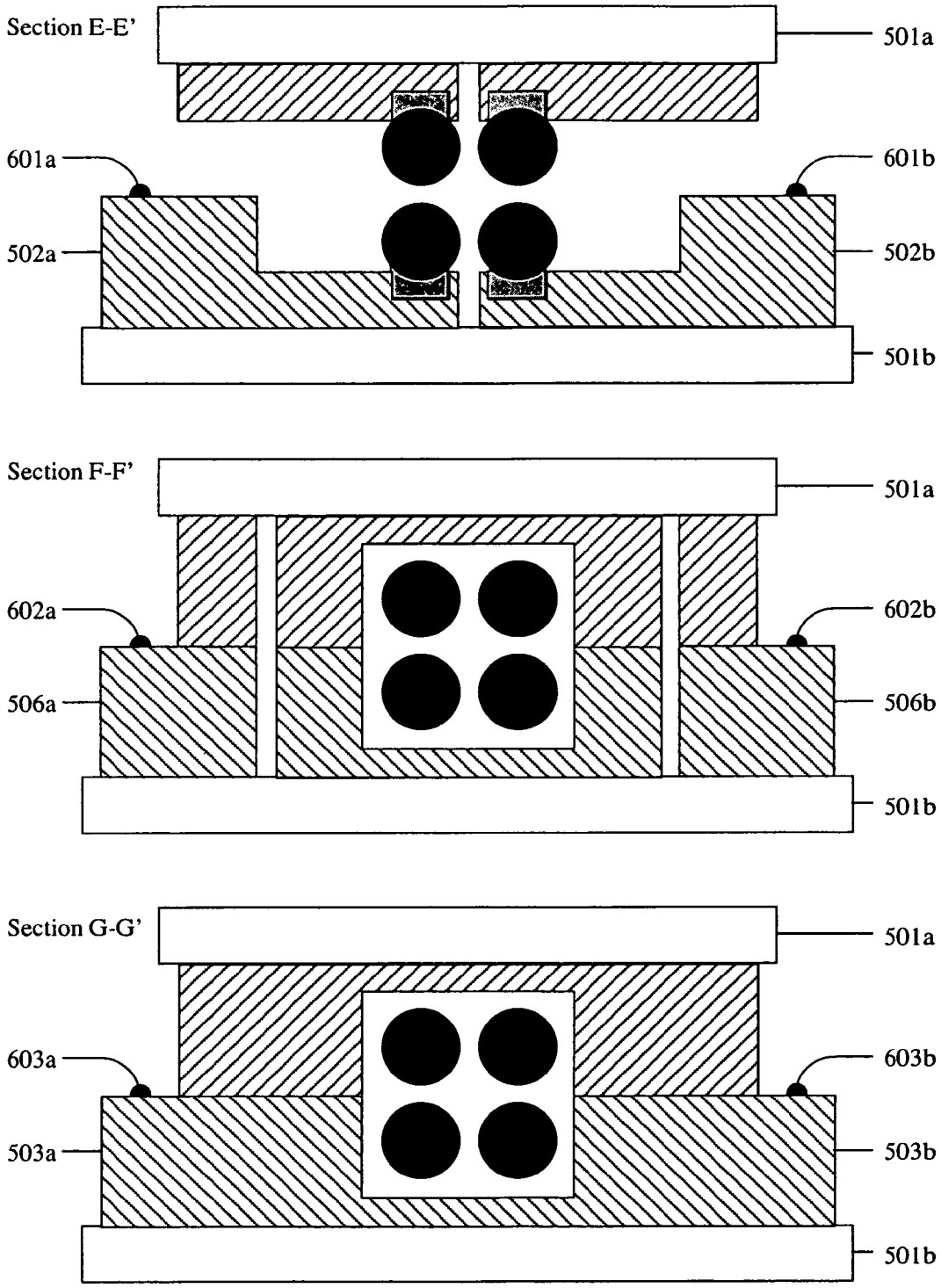
FIG. 6 shows in section an arrangement providing all electrical connections to a microfabricated quadrupole on a single substrate, according to the present invention.

FIGS. 5 and 6 show in plan and in section how all of the electrical connections to a single quadrupole may be provided on the same substrate. This arrangement is generally the most convenient for attaching bond wires to external circuitry.

The upper substrate 501*a* and the features thereon are narrower than the lower substrate 501*b*, so that contacts to the cylindrical electrodes 502*a*, 502*b* and to the shield 503*a*, 503*b* on the lower substrate are freely exposed when the two substrates are stacked together. This is achieved by providing the upper substrate with a smaller footprint than that of the lower substrate.

Contacts to the cylindrical electrodes 504*a*, 504*b* on the upper substrate are routed to pillars 505*a*, 505*b*, which are connected when the two substrates are stacked together to additional features 506*a*, 506*b* on the lower substrate. Wire bonds 601*a*, 601*b* may then be attached to features 502*a*, 502*b* connecting to the lower cylindrical electrodes. Similarly, wire bonds 602*a*, 602*b* may be attached to features 506*a*, 506*b* connecting to the upper cylindrical electrodes, and wire bonds 603*a*, 603*b* may be attached to features 503*a*, 503*b* connecting to the shield.

It will be appreciated that in each case wire bonds are attached to features existing only on the lower substrate 501*b*, thus simplifying the wirebonding operation. It will also be appreciated that this connection scheme may be extended to provide for connection to any additional similar electrodes, for example when a prefilter is used.

Figure 7:
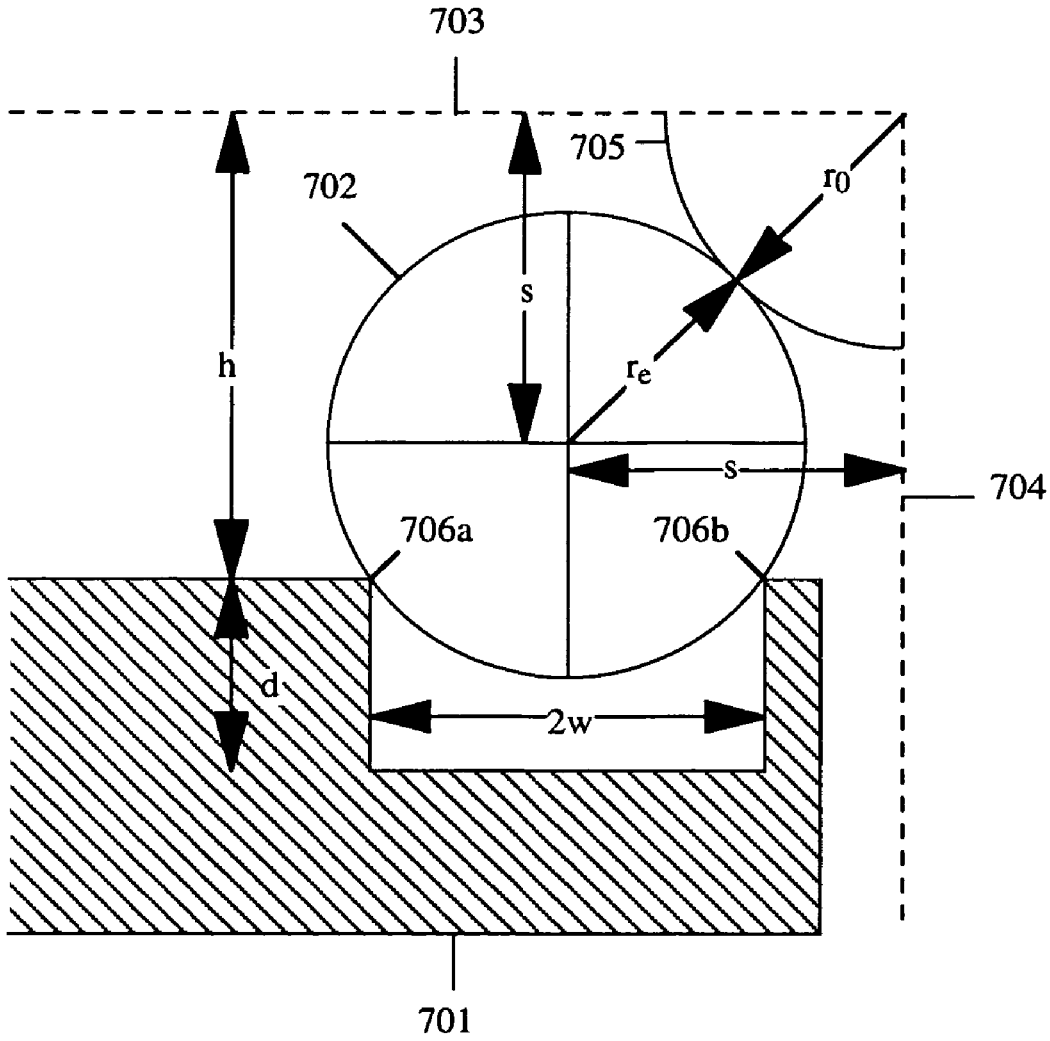
FIG. 7 shows the main geometric parameters associated with the mounting of a single cylindrical electrode, according to the present invention.

FIG. 7 shows in section how the main geometric parameters of the microfabricated quadrupole mount are reestablished. Here, the grooved feature 701 supporting a single cylindrical electrode 702 of radius $r_e$ is shown.

Conventionally it is desired to hold the electrode at an equal distance s from the two axes of symmetry 703, 704 of the electrostatic field created by the quadrupole assembly. The exact geometry is determined by the radius $r_0$ of a circle 705 that can be drawn between the four electrodes. Past work has shown that a good approximation to a hyperbolic potential is obtained from cylindrical electrodes when $r_e=1.148\ r_0$ [Denison 1971].

The value of s is then $s=\{r_e+r_0\}/2^{1/2}$. If the distance between the two contact points 706*a*, 706*b* of the cylindrical electrode 702 and the groove in the supporting feature 701 is 2 w, the height h between the contact points and the axis of symmetry 703 is $h=s+(r_e^2-w^2)^{1/2}$. Suitable choices of $r_e$, $r_0$, s, w and h therefore allow the geometry of a quadrupole to be established.

Substrates of the type described may be constructed with micron-scale precision by microfabrication, using methods such as photolithography, etching, metal-coating and dicing. However, as will be apparent to those skilled in the art, there are many combinations of processes and materials yielding similar results. We therefore give one example, which is intended to be representative rather than exclusive. In this example, etched features are formed on silicon wafers, which are then stacked together to form batches of complete substrates, which are then separated by dicing.

Figure 8:
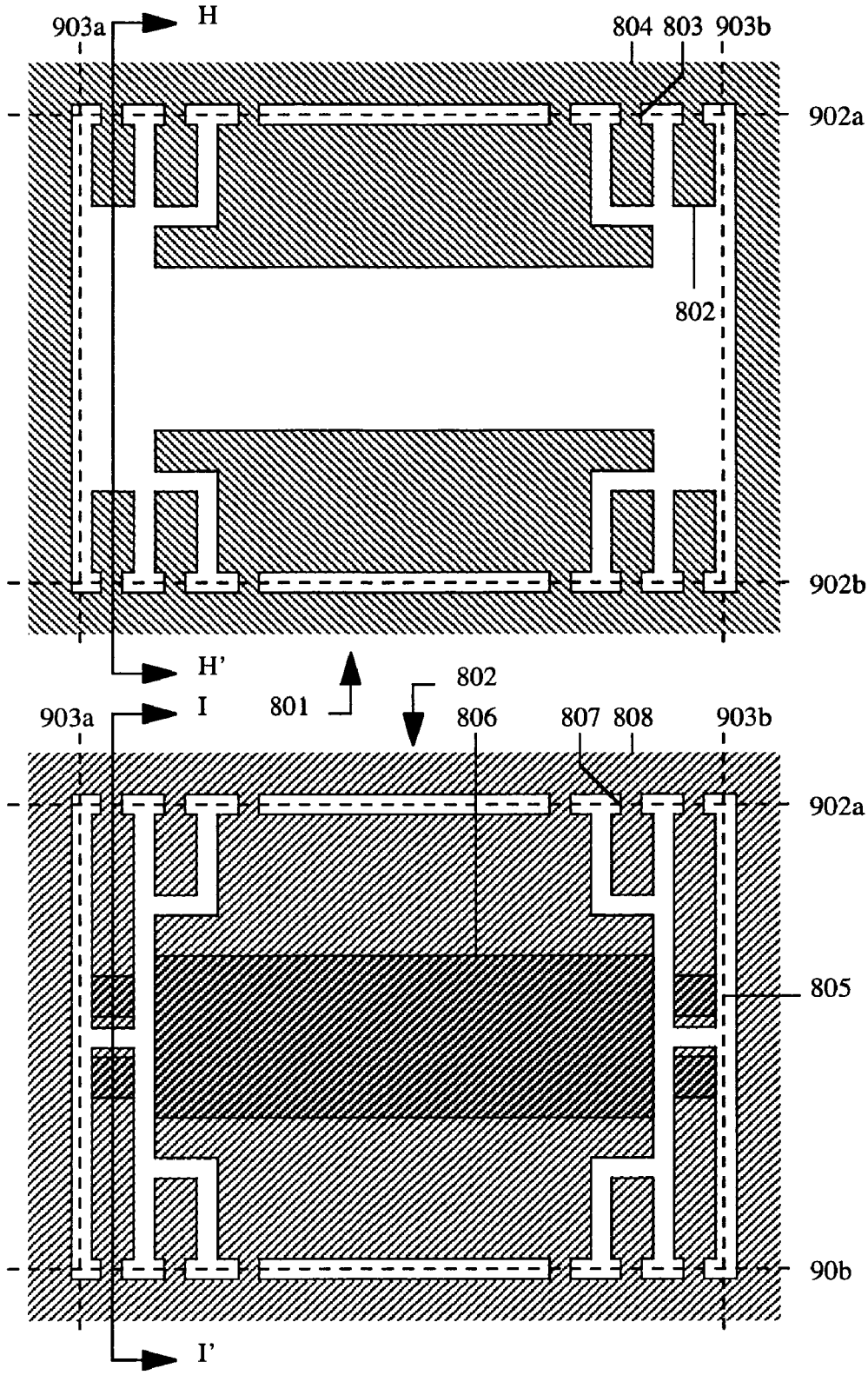
FIG. 8 shows in plan two substrates forming the mount for a miniature electrostatic quadrupole lens according to the present invention.

FIG. 8 shows how two sets of parts are formed on two separate silicon wafers. The first wafer 801 carries parts defining all features of the microfabricated substrate lying between the contact points 706*a*, 706*b* in FIG. 7. Because these features desirably have the height h shown in FIG. 7, the starting material is a silicon wafer, which is polished on both sides to this thickness. The wafer is patterned using photolithography to define the desired features (for example, the contact pad 802) together with small sections of sprue (for example 803) attaching them to the surrounding wafer (804).

The pattern is transferred right through the wafer using deep reactive ion etching, a plasma-based process that may etch arbitrary features in silicon at a high rate and with high sidewall verticality. The lithographic mask is removed, and the wafer is cleaned and then metallised, for example by RF sputtering. Suitable coating metals include gold.

The second wafer carries parts defining all features of the microfabricated substrate lying below the two contact points 706*a*, 706*b* in FIG. 7. Because the depth of these features is not critical in determining the accuracy of the quadrupole assembly, the thickness "d" of this wafer must only be sufficient to allow the cylindrical electrode to be seated. The wafer is patterned twice, firstly to define partially etched features such as the electrode seating grooves (for example, 805) and the base of the conducting shield 806, and secondly to define fully etched features outlining all the main parts. Once again, features are attached by short sections of sprue (for example, 807) to the surrounding substrate 808.

The pattern is again transferred into the wafer using deep reactive ion etching, so that the partially etched features are etched to the sufficient depth de in FIG. 7 and the fully etched features are transferred right through. Multilevel etching of this type may easily be performed using a multilevel surface mask, well known to those skilled in the art. The lithographic masks are removed, and the wafer is cleaned and metallised. Suitable coating metals again include gold.

Figure 9:
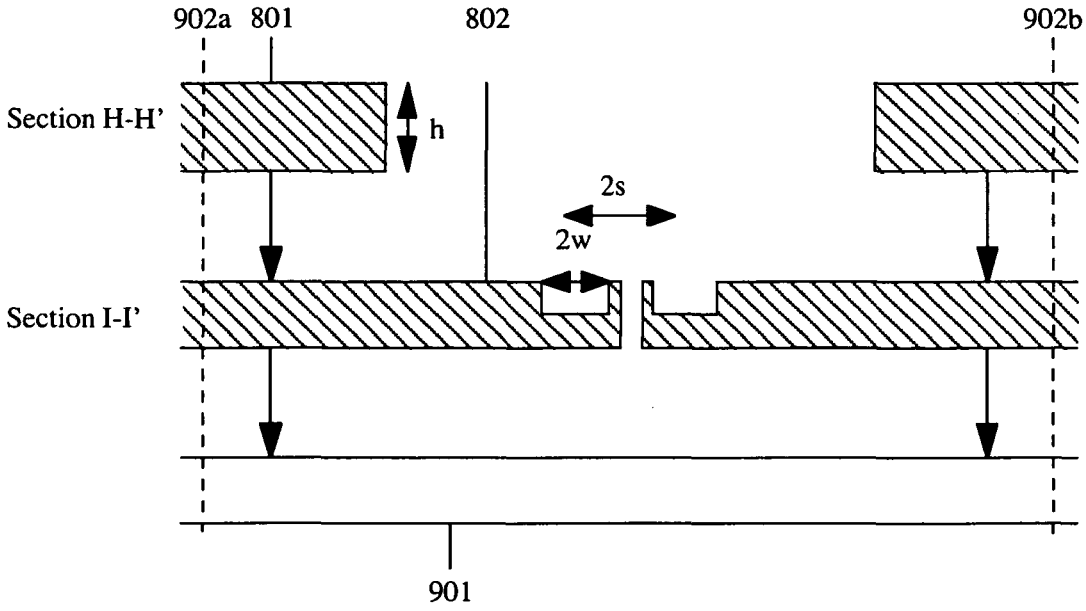
FIG. 9 shows in section the assembly of a set of substrates forming the mount for a miniature electrostatic quadrupole lens according to the present invention.

FIG. 9 shows how the wafers are assembled into a stack forming a set of complete microfabricated assemblies. The upper wafer 801 is attached to the lower wafer 802, which is in turn attached to an insulating substrate 901, for example a glass wafer. Suitable attachment methods include gold-to-gold compression bonding. Rectangular dies comprising individual microfabricated substrates are then separated using a dicing saw, for example by sawing along a first set of parallel lines 902*a*, 902*b*, which separate all sections of sprue, and a second set of orthogonal parallel lines 903*a*, 903*b*.

Quadrupole assembles are completed by inserting cylindrical electrodes into microfabricated substrates as previously shown in FIG. 2, and then assembling two substrates as previously shown in FIG. 3. Wirebond connections to external circuitry are then attached as previously shown in FIG. 6.

It will be appreciated that the processes described above can be used to construct a microfabricated quadrupole containing the main features described, namely electrically-isolated supports for cylindrical electrodes, a conducting shield and a Brubaker prefilter, the overall assembly having the correct geometrical relationship. However, it will also be appreciated that many alternative fabrication processes can achieve the same result.

For example, the lower silicon wafer may be replaced with a silicon-on-glass wafer, thus eliminating the need for the lower wafer-bonding step shown in FIG. 9. Alternatively, the two silicon wafers may be combined together into a single layer, which is multiply structured by etching to combine all the necessary features, thus eliminating the need for the upper wafer-bonding step shown in FIG. 9. In this case, the precision needed to define the height h may be achieved using a buried etch stop, which may be provided using a bonded-silicon-on-insulator wafer.

It will also be appreciated that appropriate separation between the two substrates may be achieved by the use of separate inserted conducting objects, for example conducting blocks or cylinders, eliminating the need for the upper wafer in FIG. 9.

It will also be appreciated that the necessary conducting features may be constructed from alternative materials such as metals. For example, an insulating wafer carrying a suitable set of conducting features may also be constructed by repetitive use of deep lithography to form a mould and electroplating to fill the mould with metal.

It will be appreciated that the glass may be structured by etching rather than by dicing. It will also be appreciated that the glass may be replaced with a plastic. If the plastic is photosensitive, it will be appreciated that it may be structured by lithography.

It will be understood that what has been described herein is an exemplary method of aligning sets of cylindrical electrodes in the geometry of a miniature quadrupole electrostatic lens, which can act as a mass filter in a quadrupole mass spectrometer. The electrodes are mounted in pairs on microfabricated mounting members or supports, which are formed from conducting parts on an insulating substrate. Complete segmentation of the conducting parts provides low capacitative coupling between co-planar cylindrical electrodes, and allows incorporation of a Brubaker prefilter to improve sensitivity at a given mass resolution. A complete quadrupole is constructed from two such supports, which are spaced apart by further conducting spacers. The spacers are desirably continued around the electrodes to provide a conducting screen which may form a shield. The height of the spacer is greater than the height of the mounting members such that when two supports are brought together it is contact between spacers provided on respective substrates that defines the separation between opposing substrates and ensures that electrodes that are located in a first mount are correctly spaced relative to electrodes located within a second mount. While such an exemplary embodiment is useful in an understanding of the teaching of the invention it is not intended to limit the invention in any way except as may be deemed necessary in the light of the appended claims.

There are therefore many processes that achieve a similar objective.

Within the context of the present invention the term microengineered or microengineering or microfabricated or microfabrication is intended to define the fabrication of three dimensional structures and devices with dimensions in the order of microns. It combines the technologies of microelectronics and micromachining. Microelectronics allows the fabrication of integrated circuits from silicon wafers whereas micromachining is the production of three-dimensional structures, primarily from silicon wafers. This may be achieved by removal of material from the wafer or addition of material on or in the wafer. The attractions of microengineering may be summarised as batch fabrication of devices leading to reduced production costs, miniaturisation resulting in materials savings, miniaturisation resulting in faster response times and reduced device invasiveness. Wide varieties of techniques exist for the microengineering of wafers, and will be well known to the person skilled in the art. The techniques may be divided into those related to the removal of material and those pertaining to the deposition or addition of material to the wafer. Examples of the former include:

Wet chemical etching (anisotropic and isotropic)
Electrochemical or photo assisted electrochemical etching
Dry plasma or reactive ion etching
Ion beam milling
Laser machining
Eximer laser machining Whereas examples of the latter include:

Evaporation
Thick film deposition
Sputtering
Electroplating
Electroforming
Moulding
Chemical vapour deposition (CVD)
Epitaxy These techniques can be combined with wafer bonding to produce complex three-dimensional, examples of which are the interface devices provided by the present invention.

Where the words “upper”, “lower”, “top”, bottom, “interior”, “exterior” and the like have been used, it will be understood that these are used to convey the mutual arrangement of the layers relative to one another and are not to be interpreted as limiting the invention to such a configuration where for example a surface designated a top surface is not above a surface designated a lower surface.

Furthermore, the words comprises/comprising when used in this specification are to specify the presence of stated features, integers, steps or components but does not preclude the presence or addition of one or more other features, integers, steps, components or groups thereof.

What is claimed is:

1. A quadrupole lens formed from first and second microfabricated mounts, each mount having an insulating substrate having formed thereon first and second mounting members configured to receive a first and second electrode respectively, the first and second mounting members being physically distinct from one another, wherein each mount further includes at least one spacer, the at least one spacer having a height greater than the height of either the first or second mounting members, each mounting member is formed from two support members, the support members being physically distinct from one another and each of the support members is formed as an island on the insulating substrate, the individual islands being separated by trenches formed along longitudinal and transverse axes of the mount, the support members of each mounting member are located at first and second locations on the substrate and separated from one another by the spacer, the spacer forming a shield located between the first and second locations such that a received electrode passes through the shield.

2. The lens as claimed in claim 1 wherein the shield includes a shield trench having a longitudinal axis substantially parallel to the electrode.

3. The mount as claimed in claim 2 wherein the shield trench has a conductive surface, the shield trench having a depth such that when an electrode passes through the shield it is physically separated from the conductive surface of the shield.

4. The lens as claimed in claim 2 wherein each of the first and second mounting members having a conductive surface provided on an upper surface thereof such that when an electrode is received and located on the first and second mounting members electrical contact is effected between the electrode and its respective mounting member.

5. The lens as claimed in claim 4 wherein an inserted electrode is receivable within a locating feature located in an upper surface of either of the first and second mounting members.

6. The lens as claimed in claim 5, wherein the depth of the locating feature is less than the depth of the trench formed in the shield, such that an electrode, when received in the etch feature, is suspended over the trench.

7. The lens as claimed in claim 1 having electrodes received within each of the mounting members.

8. The lens as claimed in claim 7 wherein each of the first and second mounts are arranged in a sandwich structure such that the insulating substrate of each of the first and second mounts are on opposite sides of the structure and provide an outer surface thereof.

9. The lens as claimed in claim 8 wherein on forming the sandwich structure, upper surfaces of the at least one spacer for each of the first and second mounts contact one another, thereby defining the separation distance between the opposing substrates.

10. The lens as claimed in any claim 9 wherein the contact between corresponding spacers provides a continuous conducting shield around the electrodes.

11. The lens as claimed in claim 8 provided in a quadrupole arrangement.

12. The lens as claimed in claim 8 including at least two sets of electrodes, each set being arranged in a quadrupole arrangement.

13. The lens as claimed in claim 12 wherein at least two of the at least two sets of electrodes are arranged in parallel relative to one another.

14. The lens as claimed in claim 8 wherein external electrical contact to each of the electrodes are provided through bond connections on one of the mounts.

15. The lens as claimed in claim 14 wherein each of the two mounts have a footprint different to the other, such that external access is provided to the mount providing the external electrical connection.

16. The lens as claimed in claim 1 wherein a first set of electrodes provides a pre-filter to a second set of electrodes.

17. The lens as claimed in claim 16 wherein the first set of electrodes are mountable on individual mounting members.

18. The lens as claimed in claim 16 wherein the first set of electrodes are mechanically contiguous with but electrically isolated from the second set of electrodes.

19. The lens as claimed in claim 1 wherein the first set of electrodes are coupled to a DC ground supply.

20. The lens as claimed in claim 1 wherein each of the mounting members is formed from a semiconducting material.

21. The lens as claimed in claim 20 wherein the semiconducting material is silicon.

22. The lens as claimed in claim 20 wherein features within the mounting member are defined using photolithographic or etching techniques.

23. The lens as claimed in any preceding claim wherein the substrate is formed from a glass.

24. The lens as claimed in claim 1 wherein the substrate is formed from a plastics or ceramic material.

25. A quadrupole mass spectrometer including a lens formed from first and second microfabricated mounts, each mount having an insulating substrate having formed thereon first and second mounting members configured to receive a first set of electrodes comprising first and second electrode respectively, the first and second mounting members being physically distinct from one another, the mass spectrometer further comprising a second set of four electrodes arranged in series with the first set of electrodes; the second set of electrodes being coupled to an RF supply only and the first set of electrodes being operable at both RF and DC voltages, the lens further comprising a spacer located between the first and second mounting members such that a received electrode passes through the spacer.

26. A microfabricated mass spectrometer formed from first and second microfabricated mounts, each mount having an insulating substrate having formed thereon first and second mounting members coupled to a first set of at least two electrodes, the first and second mounting members being physically distinct from one another, the mass spectrometer further comprising a second set of at least four electrodes arranged in series with the first set of electrodes; the second set of electrodes being coupled to an RF supply only and the first set of electrodes being operable at both RF and DC voltages, the lens further comprising a spacer located between the first and second mounting members such that a received electrode passes through the spacer.

* * * * *